US007722296B1

(12) United States Patent
Taylor

(10) Patent No.: US 7,722,296 B1
(45) Date of Patent: May 25, 2010

(54) RETAINING WALL SOIL REINFORCING CONNECTOR AND METHOD

(75) Inventor: Thomas P. Taylor, Colleyville, TX (US)

(73) Assignee: T&B Structual Systems, LLC, Ft. Worth, TX (US)

( * ) Notice: Subject to any disclaimer, the term of this patent is extended or adjusted under 35 U.S.C. 154(b) by 0 days.

(21) Appl. No.: 12/353,615

(22) Filed: Jan. 14, 2009

(51) Int. Cl.
*E02D 29/02* (2006.01)

(52) U.S. Cl. ..... 405/262; 405/284; 405/286

(58) Field of Classification Search ..... 405/262, 405/284, 285, 286
See application file for complete search history.

(56) References Cited

U.S. PATENT DOCUMENTS

| | | | | | |
|---|---|---|---|---|---|
| 4,324,508 | A * | 4/1982 | Hilfiker et al. | ..... | 405/284 |
| 4,725,170 | A * | 2/1988 | Davis | ..... | 405/286 |
| 4,952,098 | A * | 8/1990 | Grayson et al. | ..... | 405/262 |
| 5,044,833 | A * | 9/1991 | Wilfiker | ..... | 405/267 |
| 5,259,704 | A * | 11/1993 | Orgorchock | ..... | 405/262 |
| 5,525,014 | A * | 6/1996 | Brown | ..... | 405/262 |
| 6,024,516 | A * | 2/2000 | Taylor et al. | ..... | 405/262 |
| 6,079,908 | A * | 6/2000 | Anderson | ..... | 405/262 |
| 6,186,703 | B1 * | 2/2001 | Shaw | ..... | 405/262 |
| 6,336,773 | B1 * | 1/2002 | Anderson et al. | ..... | 405/262 |
| 6,517,293 | B2 * | 2/2003 | Taylor et al. | ..... | 405/284 |
| 6,793,436 | B1 * | 9/2004 | Ruel et al. | ..... | 405/262 |
| 6,939,087 | B2 * | 9/2005 | Ruel | ..... | 405/286 |
| 2004/0161306 | A1 * | 8/2004 | Ruel | ..... | 405/284 |

* cited by examiner

*Primary Examiner*—Frederick L Lagman
(74) *Attorney, Agent, or Firm*—Edmonds & Nolte, PC

(57) ABSTRACT

A connection apparatus for securing a facing to a soil reinforcing element wherein the soil reinforcing element has a pair of adjacent longitudinal wires with horizontally extended converging portions, a stud having a first end attached to the horizontally extended converging portions, and a second end bent upwards and terminating at a head, a facing anchor having a pair of vertically disposed loops adjacently extending from the facing and having an opening for receiving a vertical portion of the stud, and a device configured to secure the vertical portion of the stud against separation from the opening between the vertically disposed loops, wherein the stud and the attached soil reinforcing element are capable of swiveling in the horizontal and vertical directions.

26 Claims, 6 Drawing Sheets

RETAINING WALL SOIL REINFORCING CONNECTOR AND METHOD

BACKGROUND OF THE DISCLOSURE

Retaining wall structures that use horizontally positioned soil inclusions to reinforce an earth mass in combination with a facing element are referred to as Mechanically Stabilized Earth (MSE) structures. MSE structures can be used for various applications including retaining walls, bridge abutments, dams, seawalls, and dikes.

The basic MSE technology is a repetitive process where layers of backfill and horizontally placed soil reinforcing elements are positioned one atop the other until a desired height of the earthen structure is achieved. Typically, grid-like steel mats or welded wire mesh are used as earthen reinforcement elements. In most applications, the reinforcing mats consist of parallel transversely extending wires welded to parallel longitudinally extending wires, thus forming a grid-like mat or structure. Backfill material and the soil reinforcing mats are combined and compacted in series to form a solid earthen structure, taking the form of a standing earthen wall.

In some instances, a substantially vertical concrete wall may then be constructed a short distance from the standing earthen wall. The concrete wall not only serves as decorative architecture, but also prevents erosion at the face of the earthen wall. The soil reinforcing mats extending from the compacted backfill may then be attached directly to the back face of the vertical concrete wall. To facilitate the connection to the earthen formation, the concrete wall will frequently include a plurality of "facing anchors" either cast into or attached somehow to the back face of the concrete at predetermined and spaced-apart locations. Each facing anchor is typically positioned so as to correspond with and couple directly to an end of a soil reinforcing mat.

Via this attachment, outward movement and shifting of the concrete wall is significantly reduced. However, in cases were substantial shifting of the concrete facing occurs, facing anchors may be subject to shear stresses that result in anchor failure. Although there are several methods of attaching the soil reinforcing elements to the facing anchors, it remains desirable to find improved apparatus and methods offering less expensive alternatives and greater resistance to shear forces inherent in such structures.

SUMMARY OF THE DISCLOSURE

Embodiments of the disclosure may provide a connection apparatus for securing a facing to a soil reinforcing element. The connection apparatus may include a soil reinforcing element having a pair of adjacent longitudinal wires with horizontally extended converging portions, a stud having a first end attached to the horizontally extended converging portions, and a second end bent upwards and terminating at a head, a facing anchor having a pair of vertically disposed loops adjacently extending from the facing and having an opening for receiving a vertical portion of the stud, and a device configured to secure the vertical portion of the stud against separation from the opening between the vertically disposed loops, wherein the stud and the attached soil reinforcing element are capable of swiveling in the horizontal and vertical directions.

Another exemplary embodiment of the present disclosure may provide a method of securing a facing to a soil reinforcing element. The method may include providing a soil reinforcing member having a pair of adjacent longitudinal wires having horizontally extended converging portions, providing a stud having a first end attached to the horizontally extended converging portions, and a second end bent upwards forming a vertical portion, wherein the vertical portion terminates at a head, inserting the vertical portion of the stud into an opening defined by a pair of vertically disposed loops adjacently extending from the facing and configured to receive the vertical portion of the stud, and securing the vertical portion of the stud against separation from the opening between the vertically disposed loops, wherein the stud and the attached soil reinforcing member are capable of swiveling in the horizontal and vertical directions.

Another exemplary embodiment of the present disclosure may provide a facing anchor for securing a soil reinforcing element to a facing. The facing anchor may include an unbroken length of continuous wire originating with a pair of lateral extensions and forming at least one pair of vertically disposed U-shaped segments, each having a first end and a second end, wherein the first end includes the U-shaped segments and the second end forming a horizontally disposed loop.

Another exemplary embodiment of the present disclosure may provide a connection apparatus to secure a facing to an earth structure. The connection apparatus may include a stud having a first end attached to a soil reinforcing element, and a second end bent upwards and terminating at a head, a pair of U-shaped wires defining a pair of corresponding apertures and extending from the facing and configured to receive the second end of the stud therebetween, whereby the head rests on the U-shaped wires, and a rod extensible through the pair of apertures and configured to secure the second end of the stud against separation from the U-shaped wires, wherein the stud and the attached soil reinforcing element are capable of swiveling in the horizontal and vertical directions.

DETAILED DESCRIPTION

Figure 1A:
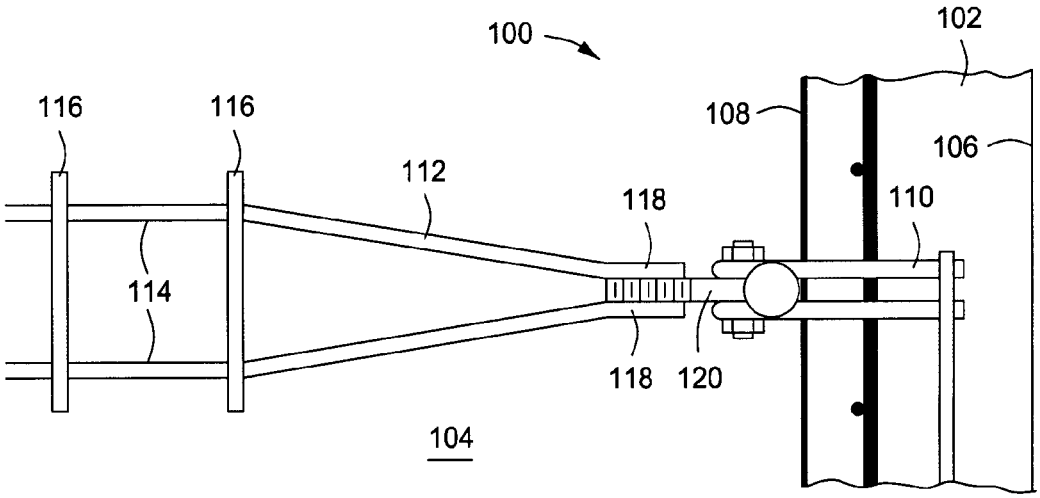
FIG. 1A is a top view of a system according to one or more aspects of the present disclosure.

It is understood that the following disclosure provides several different embodiments, or examples, for implementing different features of the disclosure. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The present disclosure may be embodied as an improved apparatus and method of connecting an earthen formation to a concrete facing of a mechanically stabilized earth (MSE) structure. In particular, one improvement of the present disclosure is a low-cost one-piece MSE connector that allows soil reinforcing mats to shift and swivel in reaction to the settling and thermal expansion/contraction of a MSE structure. Another improvement of the present disclosure is that the connector does not require its lead end to be threadably engageable with the connector. A further improvement includes a soil reinforcing element that is easier to fabricate and ship and thus has less chances for damage during shipping. Besides these improvements resulting in the advantages described below, other advantages of the improved connector and facing anchor combination include its ease of manufacture and installation.

Figure 1B:
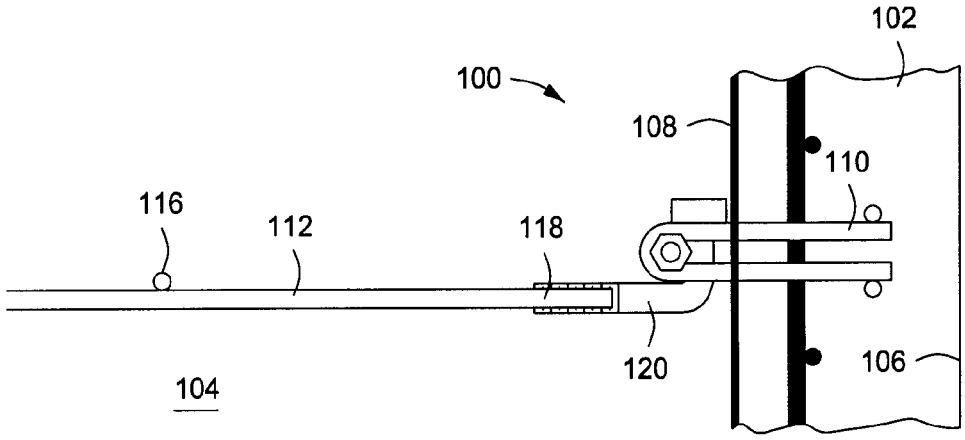
FIG. 1B is a side view of the system shown in FIG. 1A.

Referring to FIGS. 1A and 1B, illustrated is a system 100 according to one or more aspects of the present disclosure. In an exemplary embodiment, the system 100 may be used to secure a concrete facing 102 to an earthen formation 104. The facing 102 may include an individual precast concrete panel or, alternatively, a plurality of interlocking precast concrete modules or wall members that are assembled into interlocking relationship. In another embodiment, the precast concrete panels may be replaced with a uniform, unbroken expanse of concrete or the like which may be poured on site. The facing 102 may generally define an exposed face 106 and a back face 108; the exposed face 106 typically comprising a decorative architecture facing and the back face 108 located adjacent to the earthen formation 104. Cast into the facing 102, or attached thereto, and protruding generally from the back face 108, is at least one facing anchor 110.

The earthen formation 104 may encompass an MSE structure including a plurality of soil reinforcing elements 112 that extend horizontally into the earthen formation 104 to add tensile capacity thereto. In an exemplary embodiment, the soil reinforcing elements 112 may include tensile resisting elements positioned in the soil in a substantially horizontal alignment at spaced-apart relationships to one another against the compacted soil. Depending on the application, grid-like steel mats or welded wire mesh may be used as reinforcement elements, but it is not uncommon to employ "geogrids" made of plastic or other materials.

In an exemplary application, as illustrated in FIGS. 1A and 1B, a reinforcing element 112 may include a welded wire grid having a pair of longitudinal wires 114 that are substantially parallel to each other. Transverse wires 116 are joined to the longitudinal wires 114 in a generally perpendicular fashion by welds at their intersections, thus forming a welded wire gridworks. However, in alternative exemplary embodiments any angle will suffice, thus, the transverse wires 116 need not be perpendicular to the longitudinal wires as long as the welded wire grid nonetheless serves its tensile resisting purpose. In an exemplary embodiment, spacing between each longitudinal wire 114 may be about 4 in., while spacing between each transverse wire 116 may be about 6 in. As can be appreciated, however, the spacing and configuration may vary depending on the mixture of force requirements that the reinforcing element 112 must resist. The lead ends 118 of the longitudinal wires 114 generally converge toward one another and are welded to a connection stud 120.

Figure 2:
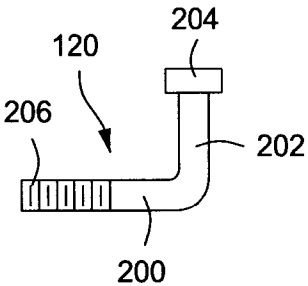
FIG. 2 is side view of a connection stud according to one or more aspects of the present disclosure.

Referring to the illustrated exemplary embodiment in FIG. 2, the connection stud 120 may include a cylindrical body 200 bent at the distal end to an angle that may be about 90° relative to the body 200 thus forming a vertical portion 202. In alternative exemplary embodiments, the angle may be less or even more than 90° and still remain within the workable scope of the disclosure. The vertical portion 202 terminates at a head 204 that is considerably larger than the diameter or cross section of the vertical portion 202. The tail end 206 of the body 200 may include indentations or thread markings capable of providing stronger resistance welding to the leading ends 118 of the longitudinal wires 114.

In an exemplary embodiment, the connection stud 120 may include a bolt with a hexagonal or square head, but may also include any material or configuration that encompasses substantially the same design intent. For example, in an alternative embodiment, the connection stud 120 may include a bent segment of bar stock or rebar including a thick washer welded to the top that acts as the head.

Figure 3C:
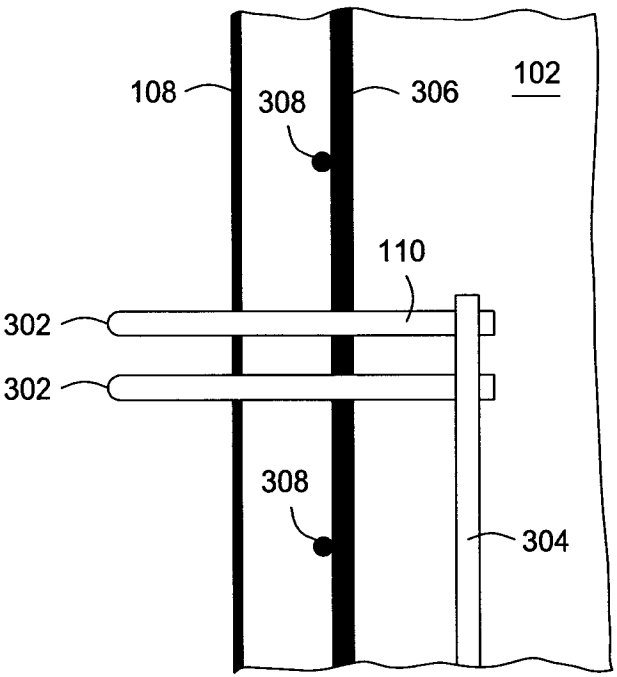
FIG. 3C is a top view of an exemplary facing anchor according to one or more aspects of the present disclosure.
Figure 3A:
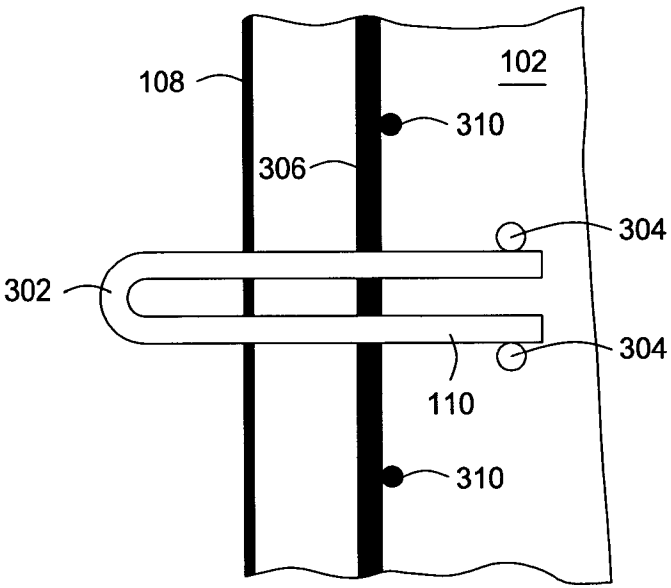
FIG. 3A is a side view of an exemplary facing anchor configuration according to one or more aspects of the present disclosure.

Referring to FIGS. 3A and 3C, illustrated are side and top views, respectively, of an exemplary facing anchor 110 according to one embodiment of the present disclosure. As illustrated, the facing anchor 110 may include a pair of exposed vertically disposed loops 302 extending substantially perpendicularly from the back face 108 of the concrete facing 102. In alternative embodiments, the facing anchor 110 may extend from the concrete facing 108 at various angles to fit any particular application and remain within the scope of the disclosure without departing from the spirit of the disclosure. The loops 302 may be fabricated from a pair of wire segments bent to form a 180° arcuate turn, thus forming a pair of U-shaped segments. The loops 302 may be welded to each other via at least one horizontal wire 304 which forms part of the anchor 110 that is embedded in the concrete panel 102.

In one embodiment, as illustrated in FIG. 3A, multiple horizontal wires 304 may be employed to render further stability and rigidity to the loops 302. Wires 304 may be welded to the top and bottom horizontally extending ends of the anchors 110. In alternative embodiments to fit various applications, the wires 304 may be attached at any suitable surface of the horizontally extending ends of the anchors 110. Furthermore, as illustrated in FIG. 5A, a pair of panel anchors 110 may be strategically coupled together by welding at least one connecting horizontal wire 304 to each anchor 110 in series. Moreover, a pair of anchors 110 may also be coupled via multiple horizontal wires 304. As such, stabilized and rigid panel anchors 110 may be strategically placed in the concrete facing 102 at predetermined spaced-apart locations to match up directly with corresponding reinforcing elements 112. As can be appreciated, any number of panel anchors 110 may be strategically coupled together by welding any number of horizontal wires 304 thereon.

Figure 3B:
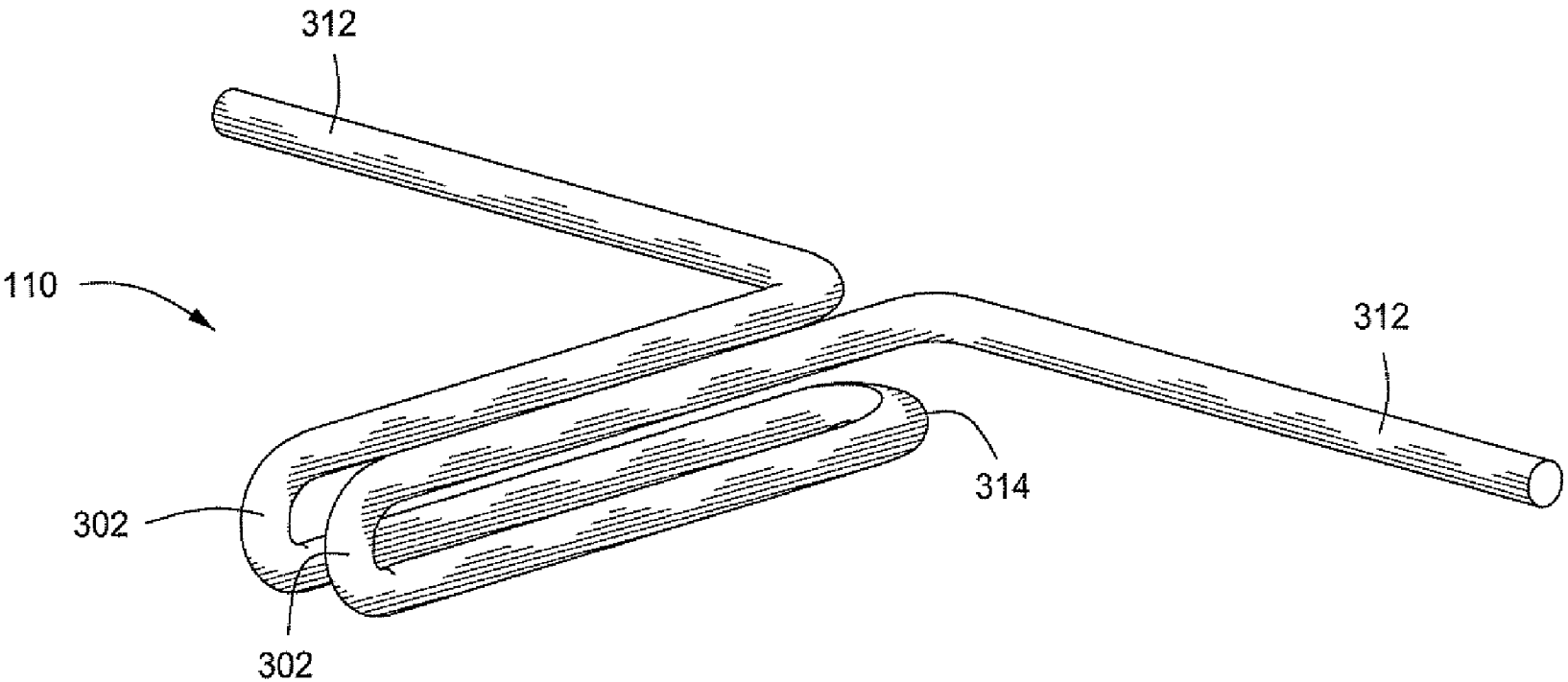
FIG. 3B is a perspective view of an exemplary facing anchor according to one or more aspects of the present disclosure.

In an alternative embodiment, as illustrated in FIG. 3B, the facing anchor 110 may consist of an unbroken length of continuous wire originating with a pair of lateral extensions 312. Similar to the embodiment in FIG. 3A, the facing anchor 110 may include a pair of exposed vertically disposed loops 302, formed by making a pair of 180° arcuate turns, thus forming a pair of U-shaped segments. However, the exemplary facing anchor 110 may also include a horizontally disposed loop 314 formed by making a single 180° arcuate turn to form a singular U-shaped segment. While the vertically disposed loops 302 may be configured to extend substantially perpendicularly from the back face 108 of the concrete facing 102, the lateral extensions 312 and horizontally disposed loop 314 may be embedded within the facing 102 to provide stability and rigidity to the connection system 100.

Also contemplated in the present disclosure, but not herein illustrated, is a continuous-wire facing anchor 110, similar to the embodiment shown in FIG. 3B, but having more than one pair of U-shaped segments 302 configured to extend substantially perpendicularly from the back face 108 of the concrete facing 102. Thus, an exemplary continuous wire anchor 110 may include a series of U-shaped segment pairs 302 and terminating in a pair of lateral extensions 312 configured to be embedded within the facing 102 to provide stability and rigidity to the connection system 100. As can be appreciated, the series of U-shaped segment pairs 302 may be spaced apart at predetermined distances, or randomly spaced to accommodate any number or design of soil reinforcing elements 112.

Referring now to FIG. 3C, which illustrates a top-view of the exemplary system 100, a reinforcing grid 306 including a plurality of transverse members 308 and horizontal members 310 may also be cast into the concrete facing 102. In operation, the reinforcing grid 306 may serve to reinforce the concrete facing 102 by providing added tensile strength. Moreover, the grid 306 may be cast into the facing 102 in front of the horizontal wires 304 of the panel anchor 110 so as to provide additional lateral strength for the facing anchors 110 by adding supplementary resistance to being pulled out of the concrete.

Figure 4A:
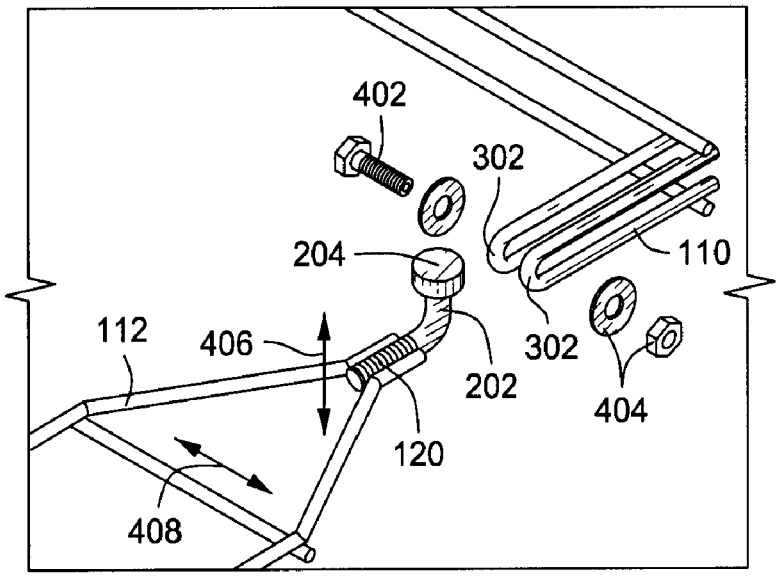
FIG. 4A is an exploded perspective view of a system according to one or more aspects of the present disclosure.
Figure 4B:
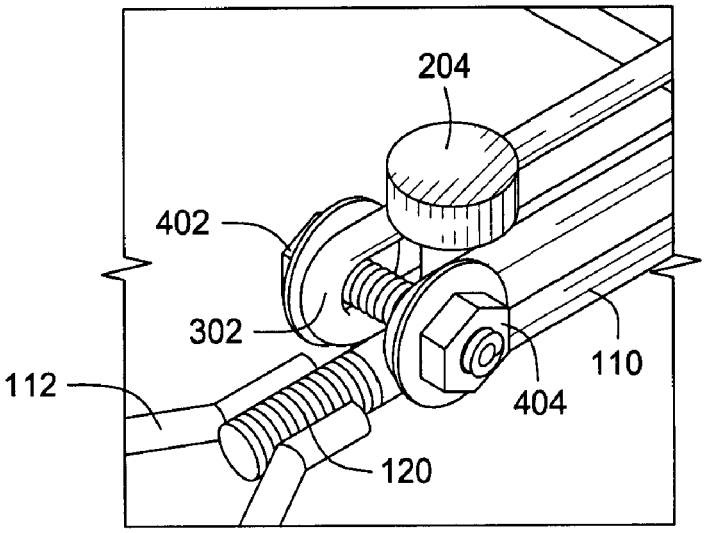
FIG. 4B is a perspective view of a system according to one or more aspects of the present disclosure.
Figure 4C:
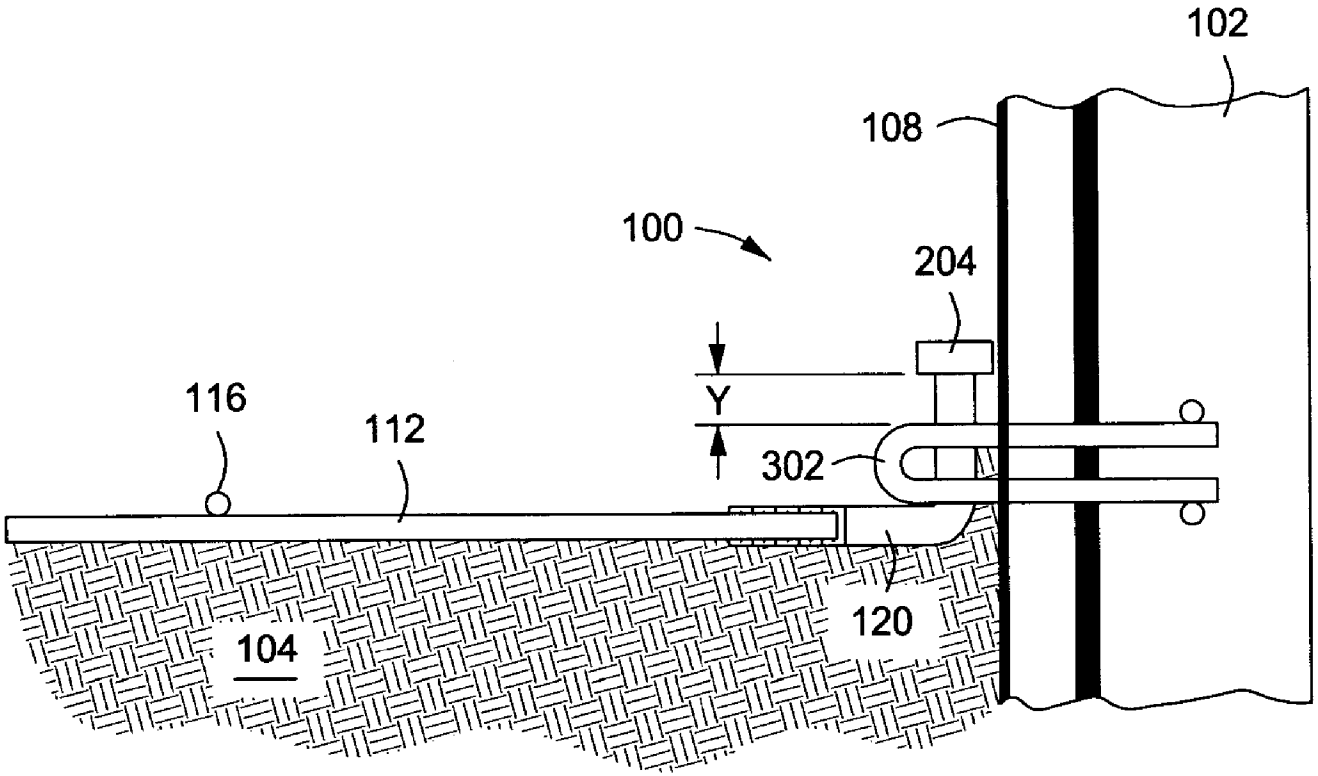
FIG. 4C is a side view of an exemplary system according to one or more aspects of the present disclosure.

Referring to FIGS. 4A and 4B, the soil reinforcing elements 112 are connected to the panel anchors 110 by inserting the vertical portion 202 of the connection stud 120 between the pair of vertically disposed loops 302 of the panel anchor 110. Since the head 204 of the connection stud 120 is enlarged, the connection stud 120 and reinforcing element 112 combination may rest on the top portion of the loops 302. Alternatively, as illustrated in FIG. 4C, the soil reinforcing element 112 may be placed on the backfill 104 in a manner so that the head 204 of the connection stud 120 extends above the top portion of the loops 302 a distance Y, instead of resting directly on the loops 302. Distance Y may be configured to provide a distance wherein the soil reinforcing element 112 may settle as the backfill 104 is compressed over time, thus avoiding potential stress on the connection.

The connection is made secure by extending a rod, such as a threaded bolt 402, through the dual apertures now defined between the loops 302, as shown in FIG. 4B. In one embodiment, a nut and washer assembly 404 may be attached to the threaded end of the bolt 402 to prevent its removal. In an alternative embodiment, the threaded bolt 402 may be replaced with any type of connecting pin having the effect of keeping the soil reinforcing element from being removed from the anchor 110. For example, a segment of wire, metal round stock, or rebar may be effectively utilized by passing said segment through the apertures defined by the vertical loops 302 and manually bending the respective ends of the segment so as to prevent its removal. In alternative embodiments, a pre-fabricated connector pin including prongs on each end may be provided that can be inserted into the apertures defined by the vertical loops 302 and serve to prohibit separation of the anchor 110 from the reinforcing element 112.

The connection stud 120 allows for movement in certain paths of both the horizontal and vertical planes thus compensating for a wide range of shifting that typically occurs in an MSE structure. For example, it is not uncommon for concrete facings 102 to shift and swivel in reaction to MSE settling or thermal expansion and contraction. Embodiments of the present disclosure may allow shifting and swiveling in the directions and paths indicated by arrows 406 & 408 in FIG. 4A. Therefore, in instances where movement occurs, the soil reinforcements 112 are capable of shifting and swiveling correspondingly thereby preventing damage or misalignment to the concrete facing 102. Moreover, because the connection stud 120 may swivel, during system 100 construction the soil reinforcing element 112 need not be situated perpendicular to the back face 108 of the facing panel 102. Instead, the soil reinforcing element 112 may be attached at any angle relative to the back face 108. In practice, this may prove advantageous since it allows the system 100 to be employed in areas where a vertical obstruction, such as a drainage pipe, catch basin, bridge pile, or bridge pier may be required.

Figure 5B:
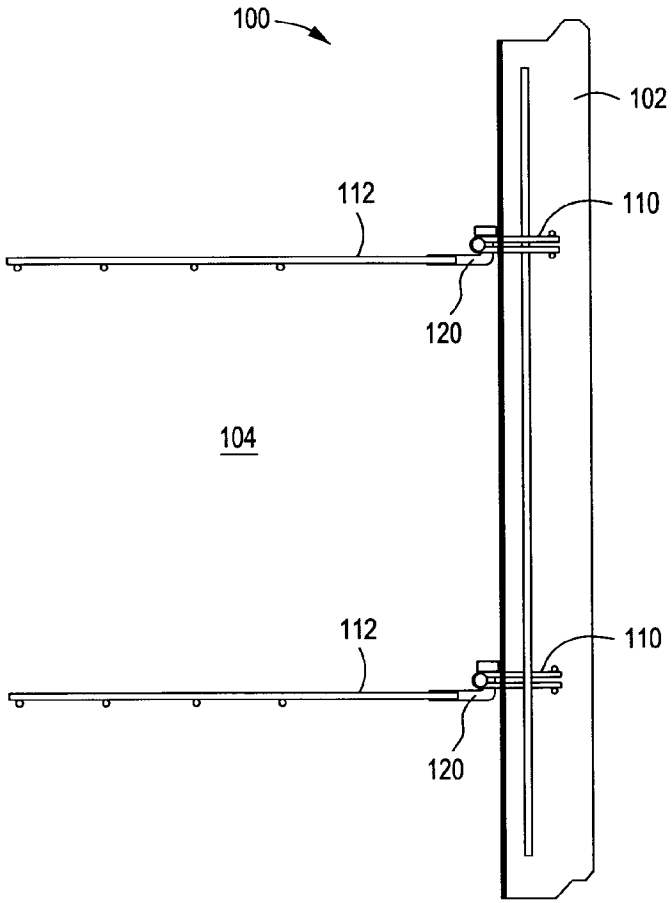
FIG. 5B is a side view of a series of a system according to one or more aspects of the present disclosure.
Figure 5A:
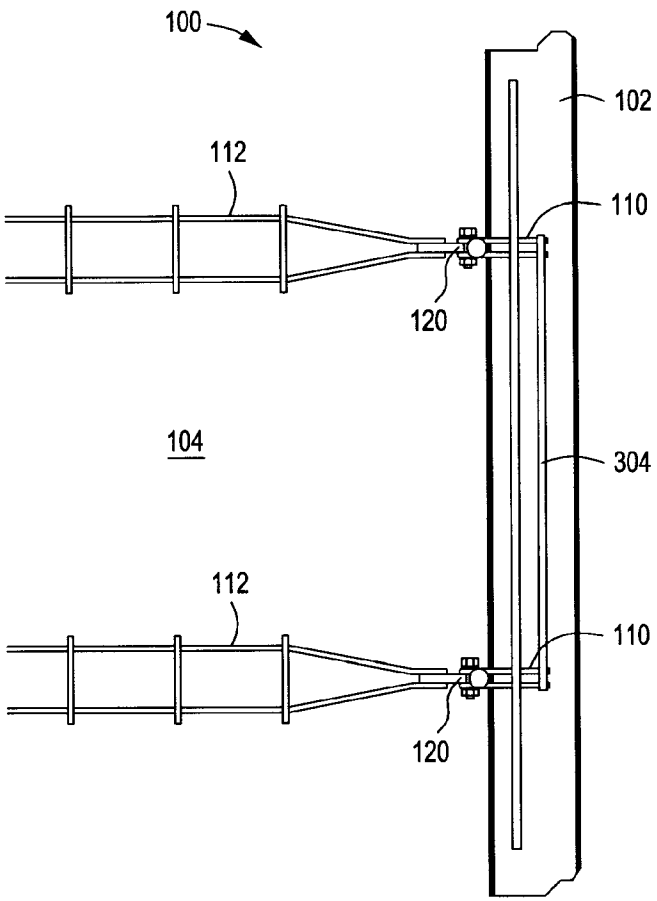
FIG. 5A is a top view of a series of a system according to one or more aspects of the present disclosure.

Referring to FIGS. 5A and 5B, illustrated are top and side views, respectively, of an exemplary embodiment of the system 100 of the present disclosure. As can be seen, the system 100 may be employed in series, both vertically and horizontally.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired earth retaining structures. Therefore, the claims should be interpreted in a broad manner, consistent with the present disclosure.

I claim:

1. A connection apparatus for securing a facing to a soil reinforcing element, comprising:

a soil reinforcing element having a pair of adjacent longitudinal wires with horizontally extended converging portions;

a stud having a first end attached to the horizontally extended converging portions, and a second end bent upwards and terminating at a head;

a facing anchor comprising an unbroken length of continuous wire originating with a pair of outward lateral extensions, the facing anchor having a pair of vertically disposed U-shaped loops adjacently extending from the facing and having an opening for receiving a vertical portion of the stud; and a device configured to secure the vertical portion of the stud against separation from the opening between the vertically disposed loops, wherein the stud and the attached soil reinforcing element are capable of swiveling in the horizontal and vertical directions.

2. The connection apparatus of claim 1, wherein the first end of the stud is welded to the converging extended portions of the longitudinal wires.

3. The connection apparatus of claim 1, wherein the first end of the stud comprises indentations or thread markings capable of providing stronger resistance welding to the converging extended portions of the longitudinal wires.

4. The connection apparatus of claim 1, wherein the stud comprises a threaded bolt terminating in a hexagonal head.

5. The connection apparatus of claim 1, wherein the head of the vertical portion of the stud is larger than a cross section of the vertical portion and thereby operable to rest on a top portion of the vertically disposed loops.

6. The connection apparatus of claim 1, wherein the head of the vertical portion of the stud extends above a top portion of the loops when secured against separation from the opening between the vertically disposed loops, and configured to allow the soil reinforcing element to move vertically during settling without putting stress on the connection apparatus.

7. The connection apparatus of claim 1, wherein the vertically disposed loops of the facing anchor are coupled to at least one horizontal wire thereby forming a complete anchor.

8. The connection apparatus of claim 7, wherein the at least one horizontal wire is further coupled to a second complete anchor thereby forming a series of complete anchors.

9. The connection apparatus of claim 1, wherein the facing anchor comprises an unbroken length of continuous wire having at least one pair of vertically disposed loops, each corresponding to at least one horizontally disposed loop, wherein the facing anchor terminates with a pair of lateral extensions.

10. The connection apparatus of claim 1 wherein the means for securing the connection stud to the facing anchor comprises a threaded bolt having a nut and washer assembly.

11. The connection apparatus of claim 1, wherein the means for securing the stud to the facing anchor comprises a connector pin having bent prongs on each end operable to prohibit separation of the facing anchor from the reinforcing element.

12. A method of securing a facing to a soil reinforcing element, comprising:

providing a soil reinforcing member having a pair of adjacent longitudinal wires having horizontally extended converging portions;

providing a stud having a first end attached to the horizontally extended converging portions, and a second end bent upwards forming a vertical portion, wherein the vertical portion terminates at a head;

inserting the vertical portion of the stud into an opening defined by a pair of vertically disposed U-shaped loops adjacently extending from the facing and configured to receive the vertical portion of the stud, wherein the pair of vertically disposed U-shaped loops form part of a facing anchor comprising an unbroken length of continuous wire originating with a pair of outward lateral extensions; and securing the vertical portion of the stud against separation from the opening between the vertically disposed loops, wherein the stud and the attached soil reinforcing member are capable of swiveling in the horizontal and vertical directions.

13. The method of claim 12, wherein the first end of the stud is welded to the converging extended portions of the longitudinal wires.

14. The method of claim 12, wherein the first end of the stud comprises indentations or thread markings capable of providing stronger resistance welding to the converging extended portions of the longitudinal wires.

15. The method of claim 12, wherein the stud comprises a threaded bolt terminating in a hexagonal head.

16. The method of claim 12, wherein the head of the vertical portion of the stud is larger than the cross section of the vertical portion and thereby operable to rest on a top portion of the vertically disposed loops.

17. The method of claim 12, wherein the head of the vertical portion extends above a top portion of the vertically disposed loops when secured against separation from the opening between the vertically disposed loops, and configured to allow the soil reinforcing element to move vertically during settling.

18. The method of claim 12, wherein the vertically disposed loops of the facing anchor are coupled to at least one horizontal wire that is further coupled to a second pair of vertically disposed loops thereby forming a series of facing anchors.

19. The method of claim 12, wherein a pair of vertically disposed loops comprise an unbroken length of continuous wire having corresponding horizontally disposed loops and terminating with a pair of lateral extensions.

20. The method of claim 12, wherein the means for securing the connection stud to the facing anchor comprises a threaded bolt having a nut and washer assembly.

21. The method of claim 12, wherein the means for securing the stud to the facing anchor comprises a connector pin having bent prongs on each end operable to prohibit separation of the facing anchor from the reinforcing element.

22. A facing anchor for securing a soil reinforcing element to a facing, comprising:

an unbroken length of continuous wire originating with a pair of outward lateral extensions and forming at least one pair of vertically disposed U-shaped segments, each having a first end and a second end, wherein the first end includes the U-shaped segments and the second end forming a horizontally disposed loop.

23. The facing anchor of claim 22, wherein the vertically disposed U-shaped segments extend substantially perpendicular from the facing, and the pair of lateral extensions and the horizontally disposed loop are embedded within the facing.

24. The facing anchor of claim 23, wherein the vertically disposed loops are configured to receive a vertical stud that is coupled to the soil reinforcing element, whereby the soil reinforcing element is capable of swiveling in a horizontal or vertical direction when coupled to the facing anchor.

25. The facing anchor of claim 22, wherein the unbroken length of continuous wire comprises a plurality of pairs of vertically disposed U-shaped segments and a corresponding plurality of horizontally disposed loops.

26. A connection apparatus to secure a facing to an earth structure, comprising:

a stud having a first end attached to a soil reinforcing element, and a second end bent upwards and terminating at a head;

a pair of U-shaped wires defining a pair of corresponding apertures and extending from the facing and configured to receive the second end of the stud therebetween, whereby the head rests on the U-shaped wires; and a rod extensible through the pair of apertures and configured to secure the second end of the stud against separation from the U-shaped wires, wherein the stud and the attached soil reinforcing element are capable of swiveling in the horizontal and vertical directions.

* * * * *